US006254227B1

(12) United States Patent
Merz et al.

(10) Patent No.: US 6,254,227 B1
(45) Date of Patent: Jul. 3, 2001

(54) INK CARTRIDGE WITH SPILLOVER DAM

(75) Inventors: Eric A. Merz, Webster; Hiep H. Nguyen, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/616,860

(22) Filed: Jul. 14, 2000

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | |
|---|---|---|---|---|
| 4,677,448 | * | 6/1987 | Mizusawa et al. | 347/85 |
| 5,289,212 | | 2/1994 | Carlotta | 347/86 |
| 5,953,030 | * | 9/1999 | Ishinaga et al. | 347/86 |
| 5,997,121 | | 12/1999 | Altfather et al. | 347/7 |

FOREIGN PATENT DOCUMENTS

| | | | | |
|---|---|---|---|---|
| 06226390 | | 4/1996 | (JP) . | |
| 406106729A | * | 4/1999 | (JP) | 347/85 |

* cited by examiner

*Primary Examiner*—N. Le
*Assistant Examiner*—Anh T. N. Vo
(74) *Attorney, Agent, or Firm*—David J. Arthur

(57) ABSTRACT

A fluid cartridge, such as a cartridge for filling with ink for use in ink jet printhead includes a housing enclosing a wick chamber, the housing including a top wall. The housing also includes an ink chamber. A fluid conduit connects the ink chamber and the wick chamber. The outer surface of the top wall of the housing is formed with a recess. A vent opening through the top wall of the wick chamber, at the recess, provides communication between the wick chamber and the recess. A covering over the top surface of the housing encloses the recess. An outlet opening through an outer wall other than the top wall of the wick chamber provides fluid communication for the ink to flow from the wick chamber. One end of an overflow tube is in fluid communication with the recess in the top wall of the housing. The other end of the overflow tube opens to the ambient environment at another point on the exterior of the housing, such as near the outlet opening. A dam in the recess, between the vent opening and the one end of the overflow tube impedes, but does not completely obstruct the flow of spillover ink from the vent opening into the overflow tube.

4 Claims, 2 Drawing Sheets

INK CARTRIDGE WITH SPILLOVER DAM

BACKGROUND OF THE INVENTION

The present invention relates to cartridges used in supplying liquid ink to a printhead in a thermal ink jet printing apparatus.

Thermal ink jet printing is well understood in the art. U.S. Pat. No. 5,997,121 describes several aspects of such printing.

In existing thermal ink jet printing, the printhead comprises one or more ink filled channels communicating with a relatively small supply chamber, or manifold, at one end, and having an opening at the opposite end, referred to as a nozzle. In current practical embodiments of drop on demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure", exist in each of the nozzles and, by extension, within the ink supply manifold of the printhead. The attributes of creating and maintaining such back pressure are described in the U.S. Pat. No. 5,289,212, the contents of which are incorporated herein by reference.

The ink is supplied to the printhead from an ink cartridge. The ink cartridge contains a supply of ink, and is typically configured to maintain the required negative pressure. The ink cartridge is typically a user-replaceable unit that mates with the printhead of the printing apparatus.

Ink tank cartridges for supplying liquid ink to a "drop on demand" thermal ink jet printhead are well known. Such cartridges are typically formed of molded plastic material, and include an outlet opening through which the liquid ink is supplied to the printhead of the printing apparatus.

SUMMARY OF THE INVENTION

The present invention is a fluid cartridge for supplying fluid on demand, such as an ink cartridge for an ink jet printhead. The cartridge includes a housing having a top wall and side walls to define an interior chamber. A vent opening through the top wall provides fluid communication into the interior chamber. A fluid conduit extends from the vent opening to another point on the exterior of the housing. A fluid dam is placed in the fluid conduit. The fluid dam does not completely obstruct the fluid conduit.

DETAILED DESCRIPTION OF A PREFERRED EMBODIMENT

Figure 1:
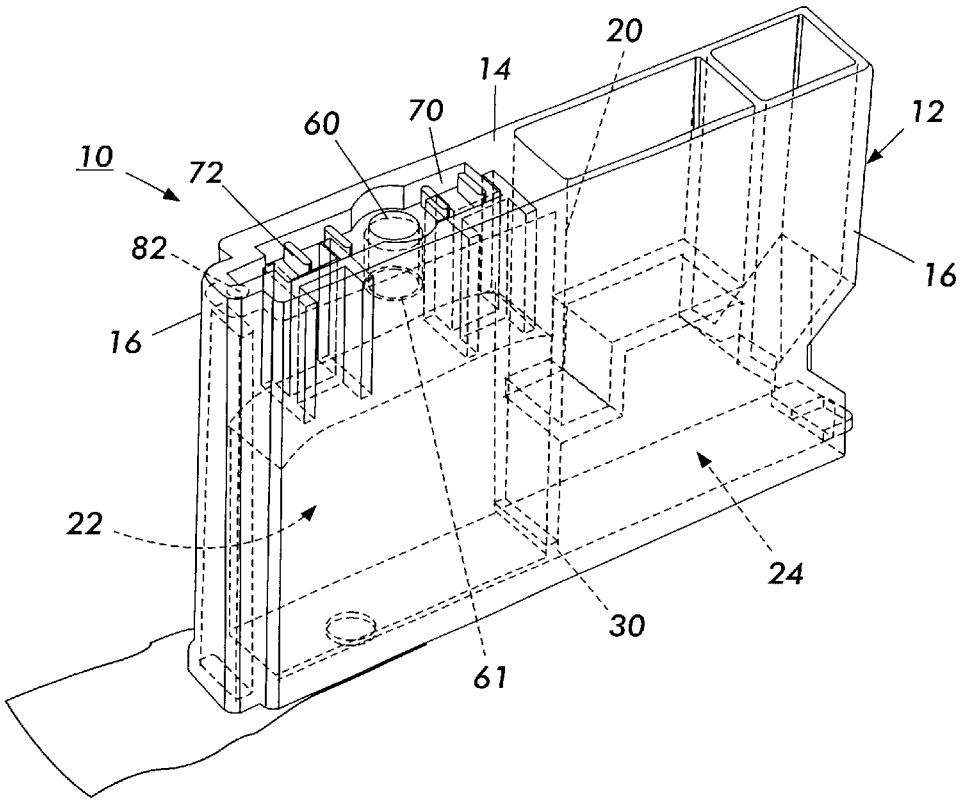
FIG. 1 is a perspective view of an exemplary ink tank incorporating a particular embodiment of the present invention showing the internal structure thereof in phantom.
Figure 2:
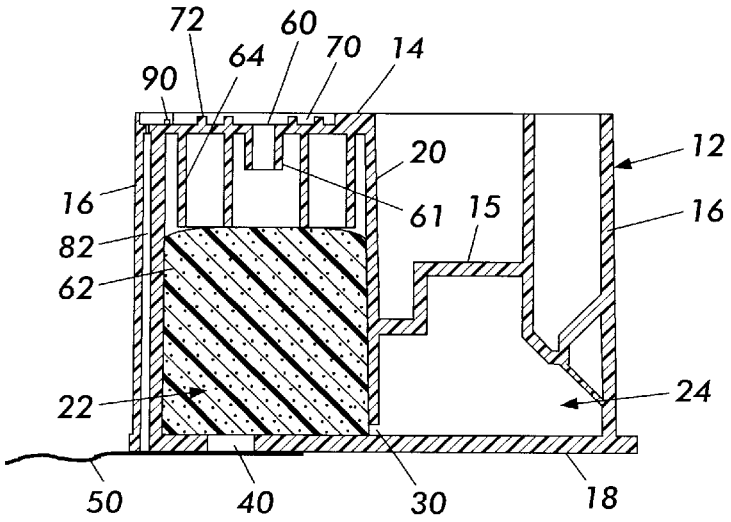
FIG. 2 is a side cross-sectional view of an ink cartridge incorporating the present invention.

Referring to FIGS. 1 and 2, a fluid cartridge 10, specifically an ink cartridge for use with a thermal ink jet printhead, includes a housing 12. In FIG. 1, the internal structure of the cartridge is shown in phantom lines. FIG. 2 is a side view in cross section. The housing 12 is formed of a top wall 14 for one portion, a top wall 15 for another portion, a plurality of side walls 16 (in the illustrated embodiment, four side walls), and a bottom wall to enclose an interior chamber. The top wall 14 of the illustrated embodiment is rectangular, having a long dimension and a shorter dimension. The size of the cartridge is determined by the fluid capacity desired for the interior. Although a rectangular shape is shown, other shapes may be used, as dictated by the printhead into which the cartridge is to fit.

In the illustrated embodiment, a divider 20 extending from the top wall 14 toward the bottom wall 18 divides the interior chamber into a wick chamber 22 and a free ink chamber 24. A fluid conduit 30 connects the wick chamber 22 and the free ink chamber 24. In the illustrated embodiment, the fluid conduit 30 is formed of a gap between the bottom wall 18 of the housing and the bottom edge of the divider wall 20.

The housing walls 15, 16, 18 forming the fluid or ink chamber are integrally formed or sealed so that there is no fluid communication between the fluid chamber 24 and the ambient environment, except through the fluid conduit 30 and the wick chamber 22. In the preferred embodiment, the top and side walls 14, 15, 16 of the housing are integrally formed with no openings except for a single vent opening 60 through the top wall 14 of the wick chamber 22. The top and side walls may be molded of a plastic material such as polypropylene, using injection molding techniques. However, those skilled in the art will recognize that other materials and manufacturing techniques may be used to form the housing.

An outlet opening 40 is formed through one of the walls forming the housing for the wick chamber 22. The outlet opening provides the point at which the cartridge interacts with the remainder of the printhead, and through which ink is supplied from the cartridge to the ink jet printhead. The outlet opening 40 may be through the bottom wall 18 of the wick chamber, which is substantially opposed to the top wall 14. However, the outlet opening may also be provided through one of the side walls 16 of the housing. An outlet opening in one of the side walls is best located in the lower portion of the side wall, near the bottom of the cartridge.

A seal 50 covers the outlet opening until the cartridge is installed in the printhead of the printing apparatus. For example, metallic tape, foil, or other material that the ink cannot penetrate is placed on the outer surface of the wall 18 having the outlet opening 40, to cover the outlet opening, and sealed to the outer surface of the bottom wall. The seal 50 is removable, so that the user can remove it before inserting the cartridge into the printhead. An extended end of the seal 50 extends beyond the end of the bottom wall 18. The user can grasp this extended end to remove the tape from the bottom wall 18 when the user is ready to install the cartridge in the printhead. However, in certain configurations, the seal may remain in place, and be punctured or otherwise penetrated by the printhead when the cartridge is installed for use in the printing apparatus.

A vent opening 60 extends through the top wall 14 of the wick chamber so the pressure inside the wick chamber 22 can be the same as the atmospheric pressure of the surrounding ambient environment. Preferably, the ink chamber 24 has no fluid communication with the ambient environment, except through the fluid conduit 30 between the ink chamber and the wick chamber, and thus through the wick chamber. A vent tube 61 extends into the interior of the wick chamber from the vent opening 60.

An ink retaining member, such as a wick 62 substantially fills the interior of the wick chamber. Wick material appropriate for use in fluid supply cartridges such as liquid ink cartridges is well understood by those familiar with the art. For example, polyether foam material may be used as the wick 62. When saturated with liquid (such as ink), the wick material facilitates maintaining the negative pressure for proper operation of the printhead. Therefore, the specific material may be different for different print apparatus configurations.

The ink chamber 24 is substantially free of ink retaining material. Liquid ink, stored in the ink chamber 24, is transferred from the ink chamber to the wick 62 through the fluid conduit 30. The ink is released through the outlet opening 40 as necessary to supply the printhead with ink for printing.

Interior structure 64 in the housing prevents the wick material 62 from contacting the vent tube 61 and the opening 60. Preventing contact between the wick material and the vent opening reduces potential leakage of ink through the vent opening. Such structure is described in copending U.S. patent application Ser. No. 09/616,383, entitled LIQUID INK CARTRIDGE WITH RECESSED FILL HOLE AND INK TANK VENT, with inventors Dennis M. Lengyel and Hiep H. Nguyen, filed on Jul. 14, 2000, assigned to the same assignee as the present application, which application is hereby incorporated by reference. However, the structure described herein can be successfully used with various cartridge configurations other than the one described in the incorporated patent application.

A fluid conduit is formed in the outer surface of the housing leading from the vent opening to another point on the cartridge housing. As illustrated, a first portion of the fluid conduit is a recess 70 formed in the outer surface of the top wall 14 of the wick portion of the housing. The recess 70 is 1/16 in (1 mm) in depth. The vent opening 60 extends through the top wall of the housing to provide fluid communication between the recess and the interior chamber, particularly with the wick chamber. Thus, the vent opening 60 through the top wall of the housing coincides with the recess 70. In accordance with the illustrated embodiment, the recess 70 surrounds the vent opening and is elongate, substantially along the long dimension of the top wall 14 of the housing. In the embodiment illustrated in FIG. 1, the recess encompasses a substantial portion of the top wall 14 of the housing, and is approximately 7/8 in (21 mm) long, and 7/16 in (10 mm) wide. However, on large cartridges, the recess may encompass only a small fraction of the area of the top wall.

Baffles or islands 72 in the recess 70 have a height equal to the depth of the recess, so that the top of each island 72 is coplanar with the outer surface of the top wall 14 of the housing. Although oval islands are shown, other shapes may be used. Each island extends across only a portion of the recess, so the island does not completely block fluid flow through the recess.

Figure 3:
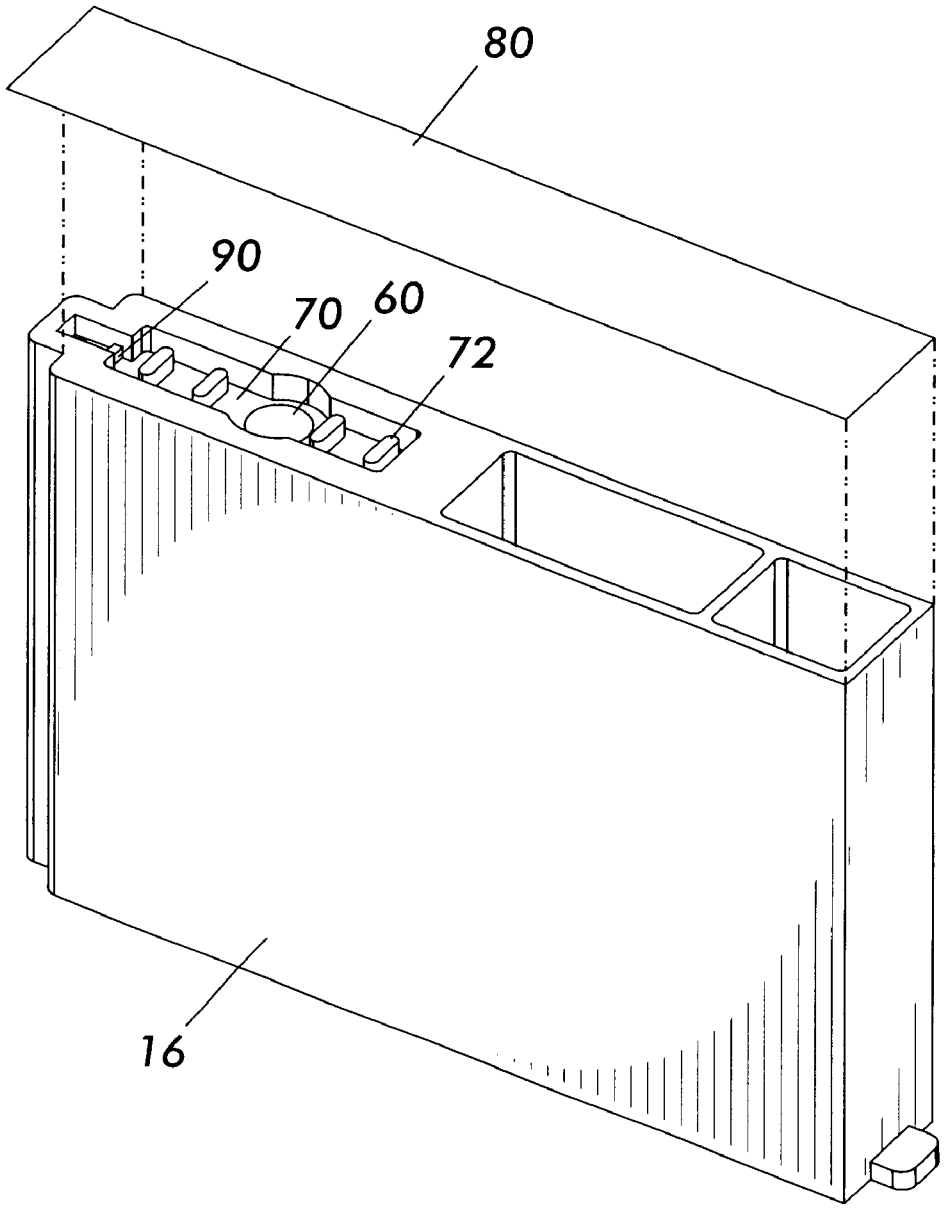
FIG. 3 is a perspective view of an ink cartridge incorporating the present invention.

Metallic or foil tape 80 or other material that is impervious to the liquid ink covers the recess (see FIG. 3). The tape is attached with adhesive to the raised portions of the outer surface of the top wall 14 that surround the recess 70. The islands 72 keep the tape from dropping into the recess. In some circumstances, the tape may also be attached to the top surfaces of the islands. Thus, the tape 80 does not seal or close off the vent opening.

One end of the recess communicates with a second portion of the fluid conduit, which is an overflow tube 82 that extends from the recess to another point on the exterior of the housing. A first end of the overflow tube 82 opens into the recess in the top wall of the housing at one end of the recess. The second end of the overflow tube is near the outlet opening 40 from the wick chamber of the housing. As previously noted, in the illustrated embodiment, the outlet opening 40 is through the bottom wall of the housing. The second end of the overflow tube is substantially coplanar with the outlet tube. The overflow tube 82 is a fluid conduit that extends along one of the side walls of the housing. The tape 50 that seals the outlet opening 40 from the wick chamber also seals the second end of the overflow tube 82. Such sealing of the overflow tube prevents leakage or evaporation of ink while the cartridge is in transit before installation by the user. However, in certain circumstances, it may be desirable to use the tape to not seal the overflow tube. Additional details of the overflow tube are contained in copending U.S. patent application Ser. No. 09/616,572, entitled INK CARTRIDGE WITH OVERFLOW CONDUIT, with inventors Edward Carrese, Dennis Lengyel, Eric Merz, and Hiep Nguyen, filed on Jul. 14, 2000, assigned to the same assignee as the present application, which application is hereby incorporated by reference.

A fluid dam or barrier 90 partially blocks fluid flow between the first portion of the fluid conduit (the recess 70 in the top wall of the housing) and the overflow tube 82. The dam 90 extends across the width of the recess 70, between the vent opening 60 and the overflow tube 82. In the particular embodiment illustrated, the recess 70 narrows in width in the end having the opening into the overflow tube 82. The dam 90 is placed across the narrow portion of the recess. The dam has a height less than the depth of the recess so that the top of the dam does not contact the tape 80. For example, the height of the dam may be one-half to one-third the depth of the recess. The gap between the top of the dam and the tape 80 ensures that the dam does not completely obstruct the flow of spill over fluid into the overflow tube.

The recess 70 is in fluid communication with the overflow tube 82. When the overflow tube is in fluid communication with the ambient environment, the vent hole 60 continues to provide atmospheric or fluid communication between the interior of the wick chamber 22 and the ambient environment.

Prior to filling with ink, the ink chamber 24 and wick chamber 22 are substantially evacuated of air or other gases, so that they contain a vacuum. However, as those familiar with the art will recognize, it is often impractical to obtain a perfect vacuum in a mass manufacturing operation. Therefore, it is almost inevitable that a small amount of air will remain in the ink chamber 24, forming a bubble, and preventing the ink from completely filling the ink chamber. Ink is supplied to the cartridge through the vent opening 60 into the wick chamber. After saturating a substantial portion of the wick 62, the ink flows into the ink chamber 24. When the ink chamber is substantially full of ink, the tape seal 80 is placed over the recess 70 to seal the interior of the cartridge.

While the seals 50, 80 block fluid exchange between the interior and exterior of the cartridge, changes in the external environmental conditions change the relative pressure between the interior and exterior of the cartridge. These changes are principally due to the air bubble in the ink chamber 24. For example, if the cartridge is heated, the air bubble with try to expand, increasing the relative pressure inside the cartridge. Also, placing the cartridge in an environment with a lower atmospheric pressure (such as by taking the cartridge to a high elevation) will cause the interior of the cartridge to have a higher pressure relative to the exterior.

If the fluid conduit to the vent opening 60 is opened (such as by removing the seal 50 from the overflow tube 82) when the internal pressure is higher than the external pressure, the air inside the chamber (particularly the air bubble in the ink chamber) expands.

When environmental changes increase the volume of air in the free ink chamber portion of the tank, ink flows through the fluid conduit 30 between the free ink chamber and the wick chamber. If the wick material 62 in the chamber becomes completely saturated, some of the ink may exit the housing interior through the vent outlet 60 into the recess. The recess 70 receives the ink that exits through the vent opening. The dam 90 contains the ink in the recess, so that it does not flow down the overflow tube 82 and exit the cartridge. This helps maintain the neatness of the outer surface of the cartridge for the user. However, should the environmental changes be extraordinarily large, enough ink may exit through the vent opening that ink may flow over the dam 90 and down the overflow tube.

The structure described above reduces the sudden ejection or squirting of ink when a seal is removed, if the opening of the vent tube 82 has been sealed and environmental changes have occurred to create a significant pressure differential between the interior and exterior of the housing. If the external pressure is significantly less than the internal pressure, the increased pressure in the overflow tube prevents the ink from entering the recess in the top wall, or the overflow tube. When the tape 50 covering the outlet of the overflow tube 82 and the outlet opening 40 from the wick chamber is removed, the overflow tube 82 is opened first, before the outlet opening 40. The air in the overflow tube 82 and the recess 70 escapes first, before allowing ink to begin to flow into the recess (if the pressure differential is sufficient). The dam 90 contains ink that enters the recess, so that it does not flow into the overflow tube. In rare cases, sufficient ink may enter the recess that the depth of ink in the overflow tube exceeds the height of the dam, and the ink flows over the dam (through the gap between the top of the dam and the tape), to reach the overflow tube.

A specific embodiment of the present invention has been described. Those skilled in the art after reading the above description will identify various modifications that can be made to the embodiment described above without departing from the spirit of the invention. For example, other shapes of ink cartridges may incorporate the invention. Also, other shapes may be incorporated into the recess and the islands, or other structures may be used, as can different styles of fluid dams or barriers. In addition, the vent opening, the outlet opening, and other elements may be placed in different locations. Therefore, the above description is illustrative, and the scope of the invention is not to be limited to the embodiment described above.

What is claimed:

1. A cartridge for supplying ink on demand to an ink-jet printhead, the cartridge comprising:

a housing having a top wall, a bottom wall, and a plurality of side walls all defining a housing interior, a vent hole through the top wall of the housing, providing fluid communication into the housing interior, a recess in the outer surface of the top wall of the housing, wherein the recess extends from the vent hole to an edge of the top wall, wherein the recess has a depth;

a vent tube extending from the recess at the edge of the top wall along one of the side walls of the housing;

a barrier extending from the floor of the recess between the vent hole and the edge of the top wall, wherein the barrier extends across the width of the recess, and has a height less than the depth of the recess; and a seal covering the top of the recess.

2. The cartridge of claim 1, wherein the recess surrounds the vent hole.

3. A fluid cartridge for supplying fluid on demand, the cartridge comprising:

a housing having a top wall and a plurality of side walls to define an interior chamber;

a vent opening through the top wall providing fluid communication into the interior chamber;

a fluid conduit extending from the vent opening to another point on the exterior of the housing, the fluid conduit comprising a recess in the outer surface of the top wall of the housing, and an overflow tube extending from the recess, wherein:

the recess has an end portion adjacent one of the side walls of the housing;

the end portion of the recess is narrower than the recess at the vent opening; and the overflow tube extends from the end portion of the recess; and a fluid dam in the fluid conduit, wherein:

the fluid dam does not completely obstruct the fluid conduit;

the dam is positioned in the recess adjacent the overflow tube;

the dam extends across the width of the recess;

the dam has a height less than the depth of the recess; and the dam is in the end portion of the recess.

4. A cartridge for filling with ink for use in an ink-jet printhead, the cartridge comprising:

a housing having a top wall and a plurality of side walls to define an interior chamber, wherein the outer surface of the top wall includes a recess;

a vent opening through the top wall providing fluid communication into the interior chamber, wherein the vent opening coincides with the recess;

an overflow tube extending from the recess to another point on the exterior of the housing;

a fluid dam in the recess, between the vent opening and the overflow tube, wherein the height of the dam is less than the depth of the recess, and the dam extends across the width of the recess; and an outlet opening through a wall of the housing providing fluid communication into the interior chamber, wherein the overflow tube has a first end at the recess, and a second end adjacent the outlet opening.

* * * * *